US007730592B2

(12) United States Patent
Krisel

(10) Patent No.: US 7,730,592 B2
(45) Date of Patent: Jun. 8, 2010

(54) IN-LINE CABLE TIE WITH FIXED AND HINGED LOCKING MECHANISMS

(75) Inventor: Robert J. Krisel, Manhattan, IL (US)

(73) Assignee: Panduit Corp., Tinley Park, IL (US)

( * ) Notice: Subject to any disclaimer, the term of this patent is extended or adjusted under 35 U.S.C. 154(b) by 551 days.

(21) Appl. No.: 11/671,719

(22) Filed: Feb. 6, 2007

(65) Prior Publication Data

US 2007/0266531 A1 Nov. 22, 2007

Related U.S. Application Data

(60) Provisional application No. 60/771,711, filed on Feb. 9, 2006.

(51) Int. Cl.
*B65D 63/00* (2006.01)
*B65D 63/16* (2006.01)

(52) U.S. Cl. ..... 24/16 PB

(58) Field of Classification Search ..... None
See application file for complete search history.

(56) References Cited

U.S. PATENT DOCUMENTS

| | | | | |
|---|---|---|---|---|
| 3,257,694 | A | 6/1966 | Litwin | |
| 3,924,299 | A | 12/1975 | McCormick | |
| 4,272,870 | A | 6/1981 | McCormick | |
| 4,658,478 | A | 4/1987 | Paradis | |
| 4,896,402 | A * | 1/1990 | Jansen et al. | 24/20 R |
| 5,146,654 | A | 9/1992 | Caveney et al. | |
| 5,440,786 | A | 8/1995 | Sorensen et al. | |
| 5,642,554 | A | 7/1997 | Sorensen et al. | |
| 5,664,294 | A | 9/1997 | Sorensen et al. | |
| 5,716,579 | A | 2/1998 | Sorensen et al. | |
| 5,745,957 | A | 5/1998 | Khokhar et al. | |
| 5,884,367 | A * | 3/1999 | Teagno et al. | 24/16 PB |
| 6,044,524 | A | 4/2000 | Sorensen et al. | |
| 6,076,234 | A | 6/2000 | Khokhar et al. | |
| 6,185,792 | B1 | 2/2001 | Nelson et al. | |
| 6,807,714 | B2 * | 10/2004 | O'Young et al. | 24/16 PB |
| 2004/0216281 | A1 | 11/2004 | Starrett | |

FOREIGN PATENT DOCUMENTS

| | | |
|---|---|---|
| GB | 2040352 A | 8/1980 |
| NL | 7012593 | 2/1972 |
| WO | 8300676 A1 | 3/1983 |

* cited by examiner

*Primary Examiner*—Robert J Sandy
(74) *Attorney, Agent, or Firm*—Robert A. McCann; Christopher S. Clancy; Aimee E. McVady

(57) ABSTRACT

A one-piece cable tie, such as an in-line cable tie, includes a hybrid locking mechanism including both a fixed locking wedge and a hinged locking wedge. The hinged locking wedge may be laterally offset from the fixed locking wedge along a longitudinal axis of an internal passageway of the cable tie head. Preferably, the hinged locking wedge is located on a top surface of the passageway while the fixed locking wedge is located on a bottom surface of the passageway. The hinged locking wedge may be located close to the strap ingress. The cable tie is preferably made of Nylon 6.6, yet can achieve both a low thread insertion force and a high loop tensile strength suitable for demanding applications. Maximized strength is achieved through use of multiple teeth on each of the hinged and fixed locking wedges.

6 Claims, 8 Drawing Sheets

110
116
150
120

110
H1
132
122
120

110
112
H1
122
132

140
152
154
T1
150
100
P1
116
110
132
130
120
122
114
112

IN-LINE CABLE TIE WITH FIXED AND HINGED LOCKING MECHANISMS

CROSS-REFERENCE TO RELATED APPLICATIONS

This application claims priority to Provisional Patent Application No. 60/771,711, filed Feb. 9, 2006, which is hereby incorporated by reference in its entirety.

FIELD OF THE INVENTION

The invention relates to a cable tie with hybrid fixed and hinged locking mechanisms to achieve a high loop tensile strength and low insertion force.

BACKGROUND OF THE INVENTION

Cable ties are well-known for use in bundling objects such as cable bundles. Integral one-piece cable ties typically include a cable tie head with a strap insertion passageway that extends perpendicular to the strap. However, some cable tie heads have an in-line strap insertion passageway that is parallel to the strap. These in-line cable ties often have a lower head profile. Either type of one-piece cable tie typically includes either a fixed wedge locking mechanism that mates with teeth on a single side of the cable tie strap or a hinged flexible wedge locking mechanism that hingedly mates with teeth on a single side of the cable tie strap.

Fixed wedge designs can achieve high loop tensile strength compared to flexible hinge wedge designs, but at the expense of a high thread insertion force. Fixed wedge designs having a single set of teeth on one side typically have a small passline clearance through the cable tie head in order to ensure loop tensile strength by maintaining connection between the fixed wedge teeth and teeth on the strap. To work effectively, this typically involves an interference fit of the strap body and teeth with the internal passageway of the head. This results in a high insertion force problem. Because of this, many fixed wedge cable tie designs require use of a tool for cable tie installation.

Flexible hinge wedge designs can achieve a lower thread insertion force because the passline clearance can be effectively increased. The flexible hinged wedge pivots out of the way during strap insertion. However, upon an attempt to withdraw the strap, the teeth of the hinged locking wedge engage corresponding teeth in the strap and urge the hinged locking wedge mechanism downward into tighter engagement with the strap and a bottom wall of the cable tie head. Thus, upon attempted withdrawal, the effective passline clearance is reduced. However, because of the flexible hinge, this type of locking mechanism typically has lower loop tensile strength compared to a fixed locking wedge.

Currently, there are no in-line threading cable ties that achieve the required tensile strength in the electrical contractor market without an excessive thread force. Thus, it would be desirable to provide a cable tie having the strength of a fixed wedge part and the thread force of a moving wedge part.

An aspect of the invention is to provide an improved cable tie, preferably an in-line style cable tie, that can achieve a high loop tensile strength and a low thread insertion force. In particular, the invention can achieve up to about 60% higher loop tensile strength than a conventional hinged locking wedge cable tie while achieving up to about a 70-75% decrease in thread insertion force compared to a conventional fixed locking wedge cable tie.

In accordance with an aspect of the invention, a cable tie with hybrid locking mechanism includes a hinged locking wedge engaging a series of teeth on one side of the strap body and a fixed locking wedge engaging a series of teeth on an opposite side of the strap body.

In accordance with another aspect of the invention, a cable tie with hybrid locking mechanism provides fixed locking wedge teeth on a bottom side of the internal passageway of the locking head and hinged locking wedge teeth on a top side of the internal passageway of the internal passageway of the locking head.

In accordance with a further aspect of the invention, a cable tie with hybrid locking mechanism provides the hinged locking wedge laterally offset from the fixed locking wedge in the direction of strap insertion.

In accordance with yet another aspect of the invention, a cable tie with hybrid locking mechanism has an increased head length to isolate tensioning and cutoff of the strap from the locking wedges. This results in a cable tie design that is more tolerant of abusive installation practices.

In accordance with additional aspects of the invention, the cable tie has substantial flexibility due to the strap teeth being provided on both sides of the cable tie body.

BRIEF DESCRIPTION OF THE DRAWINGS

Various disclosed exemplary embodiments of a cable tie will be described in detail, with reference to the following figures, wherein.

DETAILED DESCRIPTION OF EMBODIMENTS OF THE INVENTION

Figure 1:
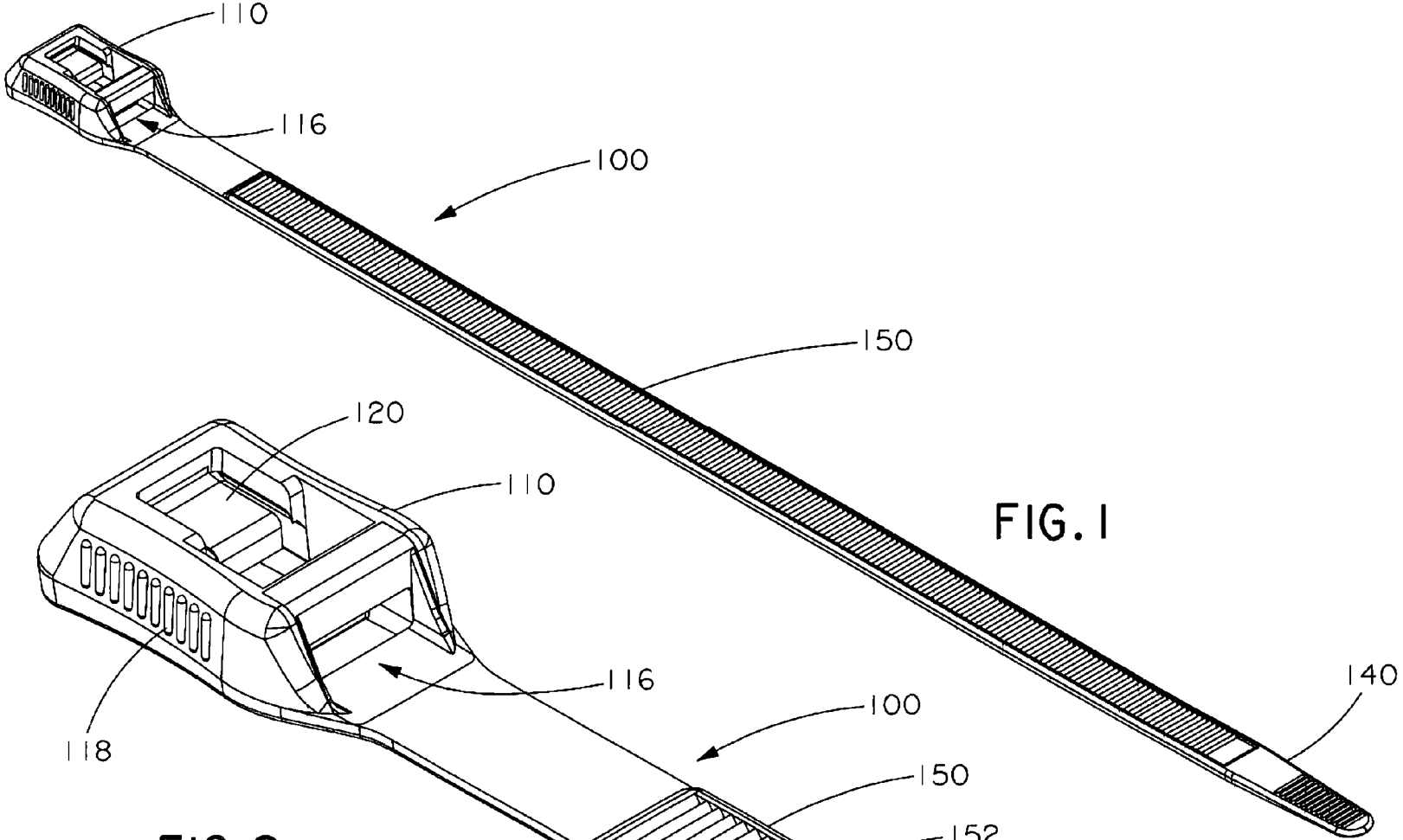
FIG. 1 shows a perspective view of an in-line cable tie with a hybrid locking mechanism according to the invention.
Figure 2:
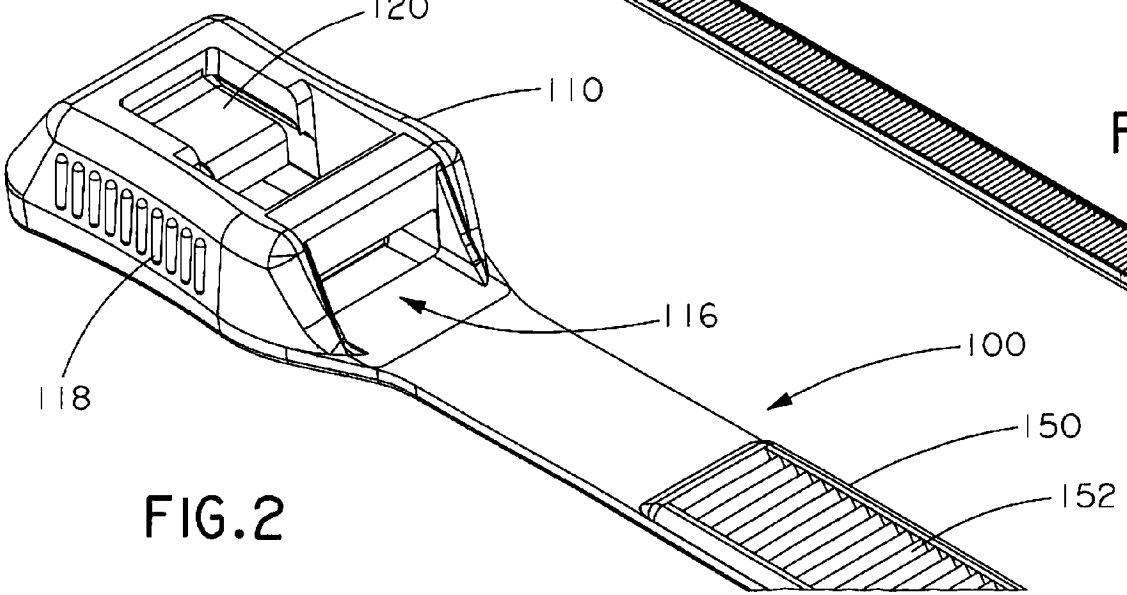
FIG. 2 shows a partial perspective view of the cable tie of FIG. 1.
Figure 3:
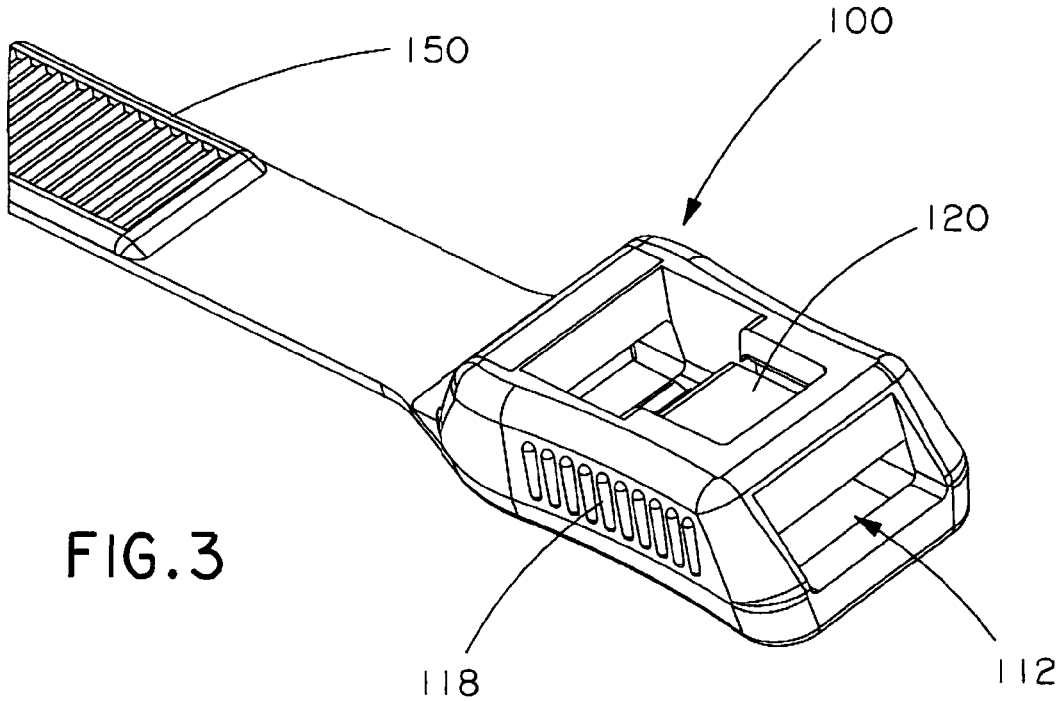
FIG. 3 shows another partial perspective view of the cable tie of FIG. 1.
Figure 4:
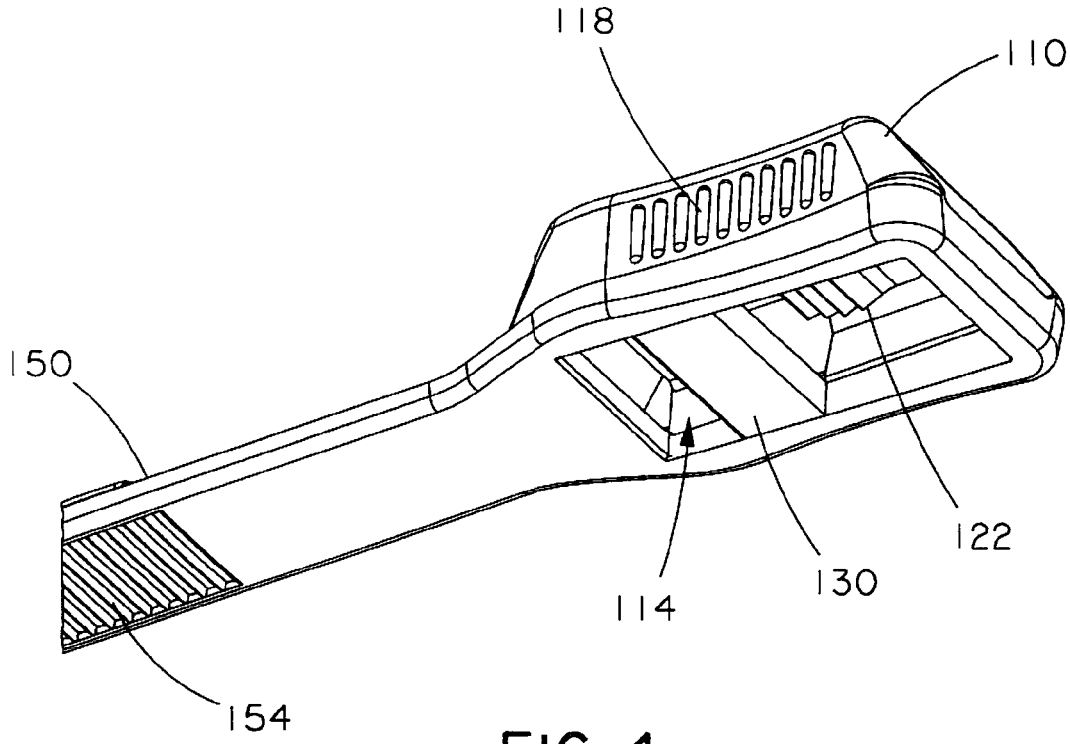
FIG. 4 shows a bottom perspective view of the cable tie of FIG. 3.
Figure 5:
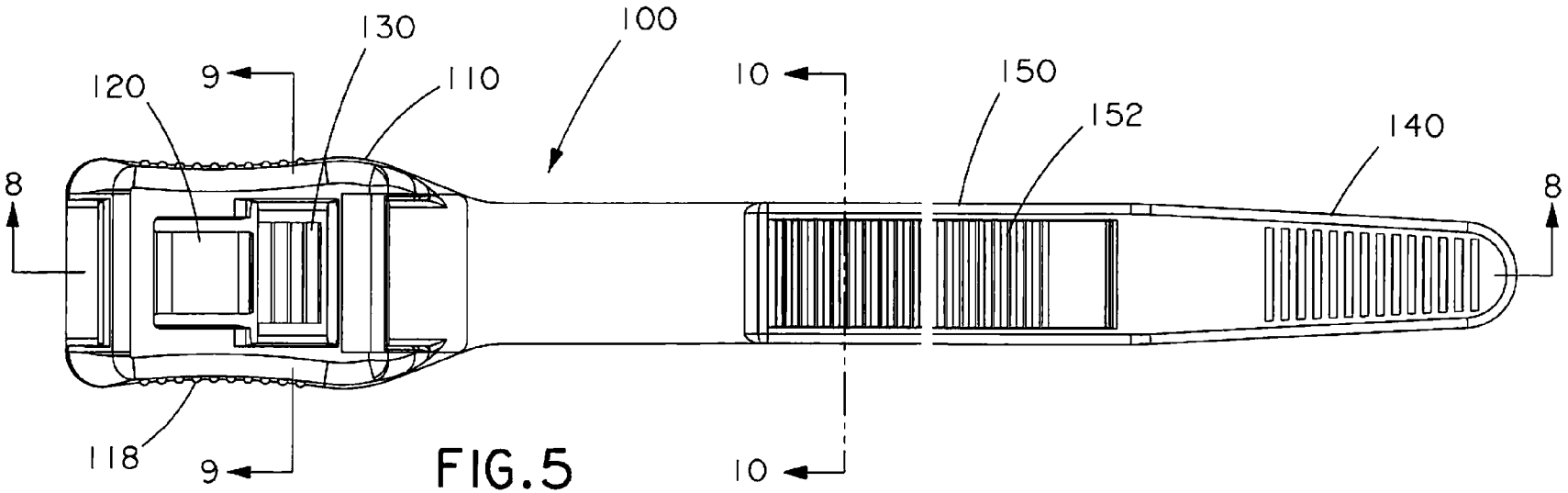
FIG. 5 shows a top view of the cable tie of FIG. 1.
Figure 6:
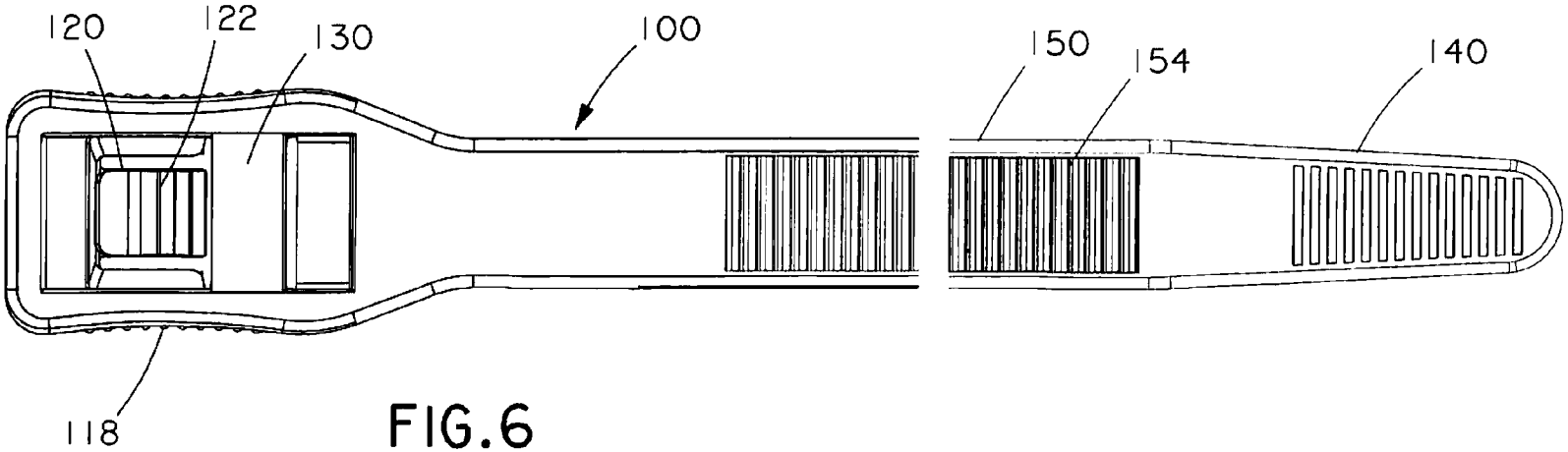
FIG. 6 shows a bottom view of the cable tie of FIG. 1.

FIGS. 1-10 show various views of an exemplary cable tie 100 according to the invention. Cable tie 100 includes a cable tie head 110 on one end, a cable strap tail 140 on an opposite end, and an elongated planar strap 150 therebetween. Strap 150 has a thickness T1 (FIG. 8) and two major surfaces. A first major surface forms a top side of the strap and has a plurality of first teeth 152 extending along a substantial portion of the surface (FIG. 5). A second major surface forms a bottom side of the strap and has a plurality of second teeth 154 extending along a substantial portion of the surface (FIG. 6). Cable tie 100 is made of a suitable plastic material, such as nylon. A preferred material is Nylon 6.6.

Figures 7, 8, 9, 10:
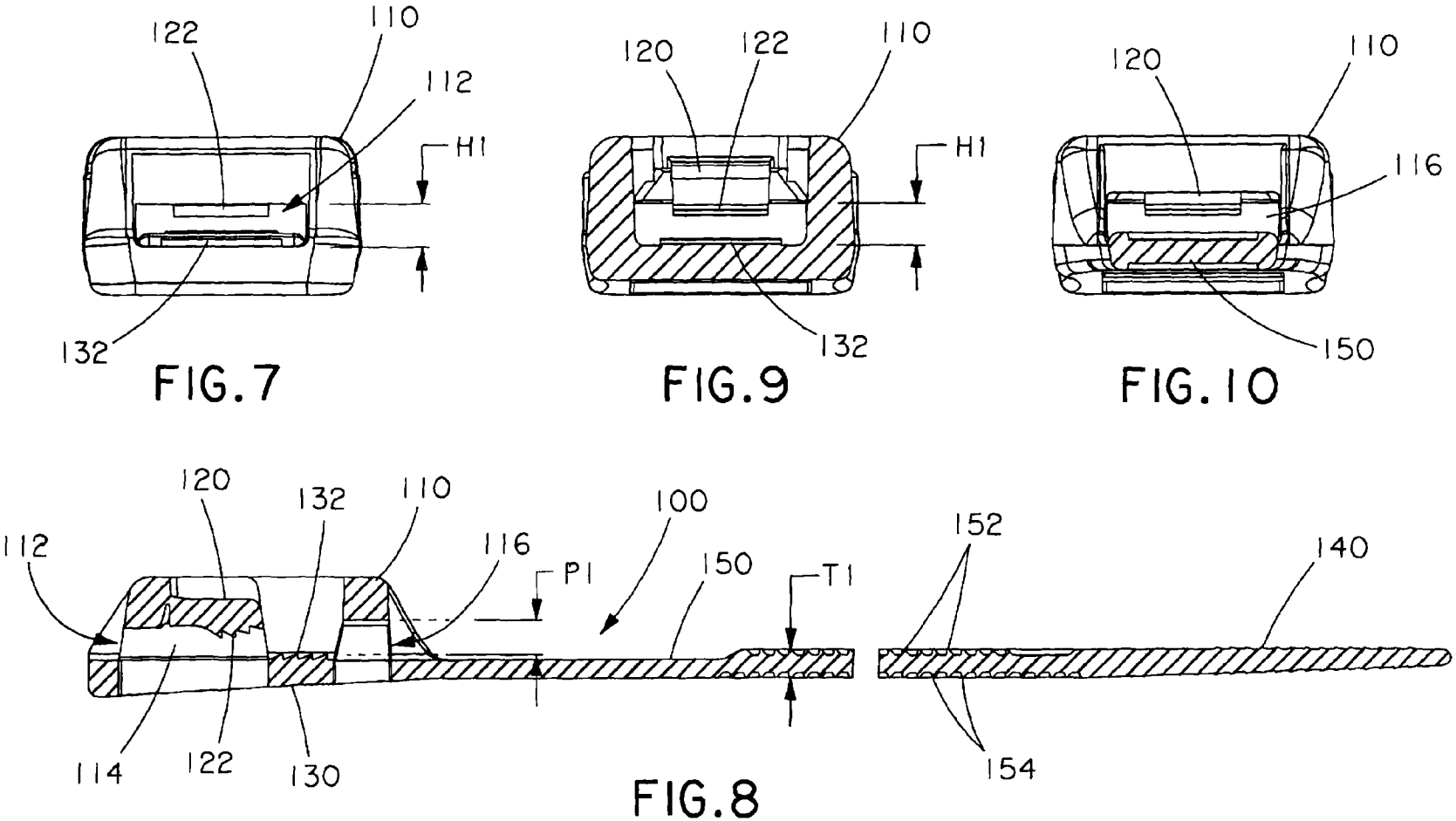
FIG. 7 shows all end view of the cable tie of FIG. 1 showing the cable tie head.
FIG. 8 shows a cross-sectional view of the cable tie of FIG. 5, taken along lines 8-8.
FIG. 9 shows a cross-sectional view of the cable tie of FIG. 5, taken along lines 9-9.
FIG. 10 shows a cross-sectional view of the cable tie of FIG. 5, taken along lines 10-10.

As best illustrated in FIG. 8, cable tie head 110 includes a strap ingress 112, a strap egress 116 and an internal passageway 114 extending therebetween sized and shaped to receive tail 140 therethrough. The internal passageway 114 is defined by top, bottom and side peripheral surfaces and sized to receive tail 140 and strap 150 therethrough with a predetermined minimum passline clearance. For example, the ingress 112 has a height H1 and passageway 114 has a passline clearance P1 that is at least nominally larger than strap thickness T1 to enable a low thread insertion force. External side surfaces of cable tie head 110 may include thumb or finger grips 118 to assist in gripping of the cable tie. An exemplary embodiment uses a series of closely spaced parallel protrusions 118 oriented perpendicular to strap 150.

Retention of strap 150 within the head is achieved by a hybrid locking device comprising a hinged locking wedge 120 provided on one of the top and bottom sides of the passageway and a fixed locking wedge 130 provided on an opposite side of the passageway. In a preferred illustrated embodiment, hinged locking wedge 120 is provided on the top side of passageway 114 and the fixed locking wedge 130 is located on the bottom side. This allows for a passageway that is closer to the bottom of cable tie head 110, because the fixed locking wedge 130 can be formed with a smaller thickness since it does not need clearance for pivotal hinged movement as does hinged locking wedge 120. This enables the portion of strap 150 exiting egress 116 of the head to lie substantially flat on top of the remainder of strap 150. However, the orientation of the locking wedges can be reversed.

As discussed above, there are problems with each of the typical flexible hinged locking wedge and fixed locking wedge designs. However, because cable tie head 110 provides a hybrid locking mechanism with both locking mechanism types, it achieves benefits from both locking wedge designs. These advantages will be described with reference to FIGS. 7-13.

Figure 11:
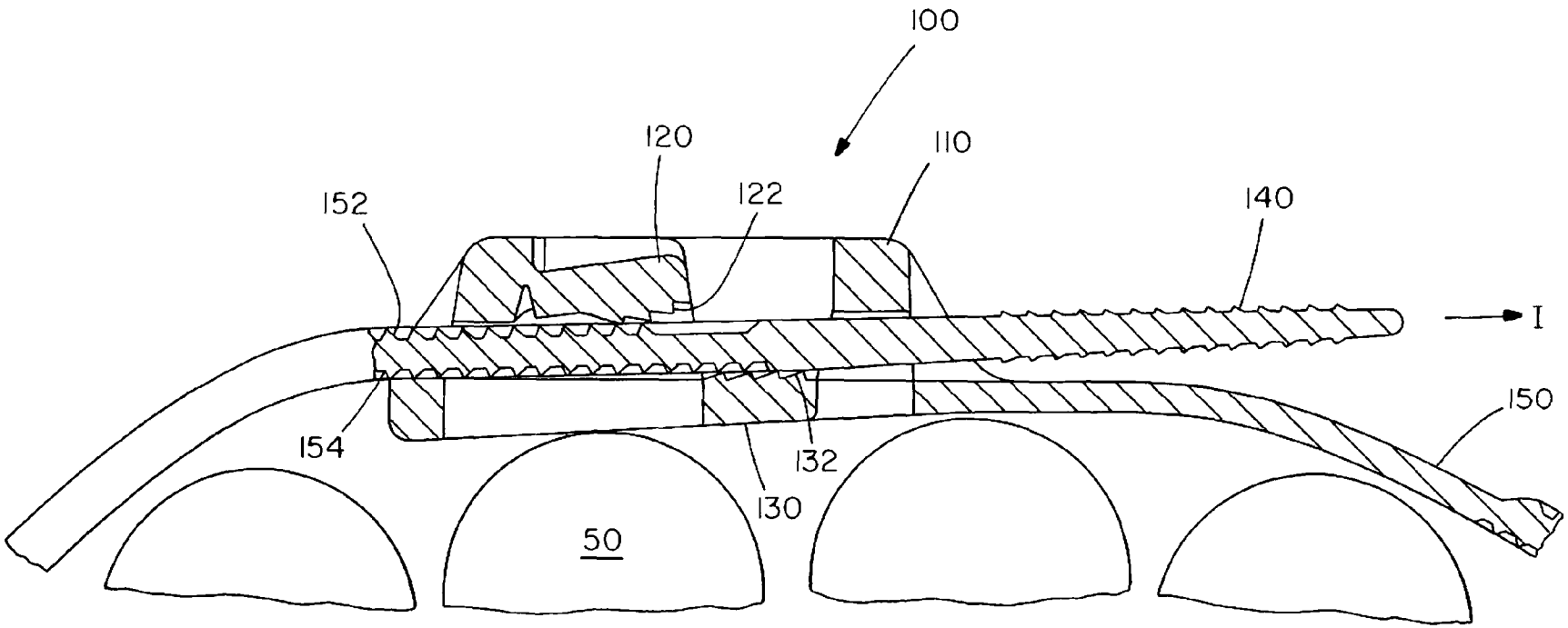
FIG. 11 shows a cross-sectional view of the cable tie of FIG. 8, wrapped around a cable bundle with the cable tie strap end being initially inserted into the cable tie head.

Ingress opening 112 and egress opening 116 have a height H1 that provides an increased passline clearance relative to the thickness T1 of strap 150. That is. H1 is sufficiently larger than T1 to allow strap 150 to readily pass through passageway 114 with little or no interference. Moreover, because hinged locking wedge 120 is hinged for movement away from passageway 114 during insertion of tail 140 and strap 150 into the passageway, locking wedge 120 also does not create a large impediment to strap insertion. See, for example, movement of wedge 120 from the static position in FIG. 8, prior to strap insertion, to the position shown in FIG. 11, when the strap has been inserted into the passageway in an insertion direction 1. Further, because of the at least nominal passline clearance P1 and the lack of any obstructions immediately above fixed locking wedge 130, teeth 152, 154 of strap 150 are also able to pass fixed locking wedge 130 with a low thread insertion force as also shown in FIG. 11. It has been found that the thread insertion force can be 25-30% of the force commonly found in conventional cable ties with comparable loop tensile strength using a fixed locking wedge design.

Figure 12:
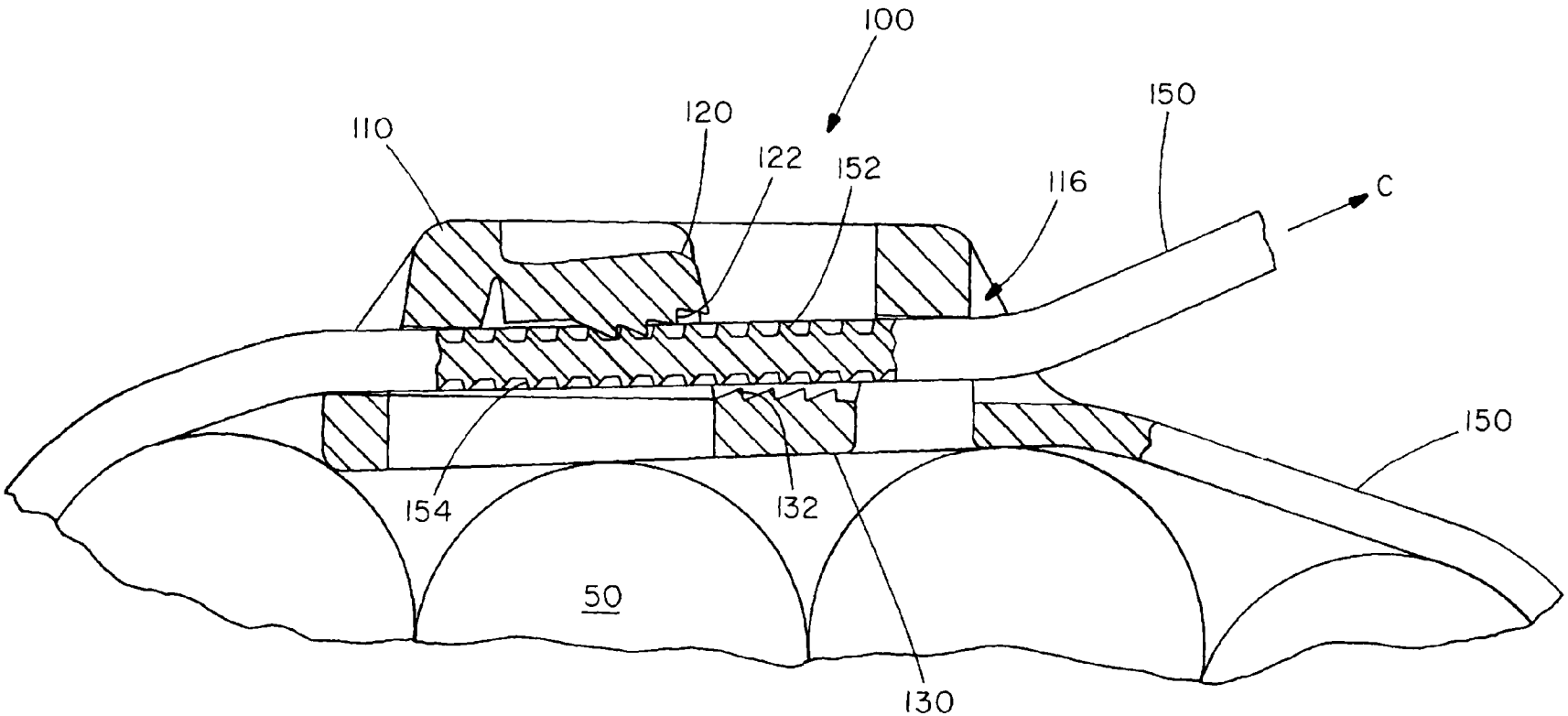
FIG. 12 shows a cross-sectional view of the cable tie of FIG. 11, after tightening of the cable tie and severing of the excess strap length.

Upon suitable tightening of strap 150 about a bundle 50 as shown in FIG. 12, strap 150 can be left alone or may be cut off by use of a conventional cutoff tool. The cable tie head has been lengthened by about 33% from a conventional in-line cable tie with only a hinged locking wedge. This added length allows for a fixed locking wedge and extends from the fixed locking wedge to egress opening 116. Thus, effects from tensioning and cutoff of the strap 150 can be better isolated from the locking wedges 120, 130. This results in a cable tie design that is more tolerant of abusive installation practices without materially altering the teeth contact between the wedges and the teeth of the strap due to excessive stretching, binding, strain, etc.

Figure 13:
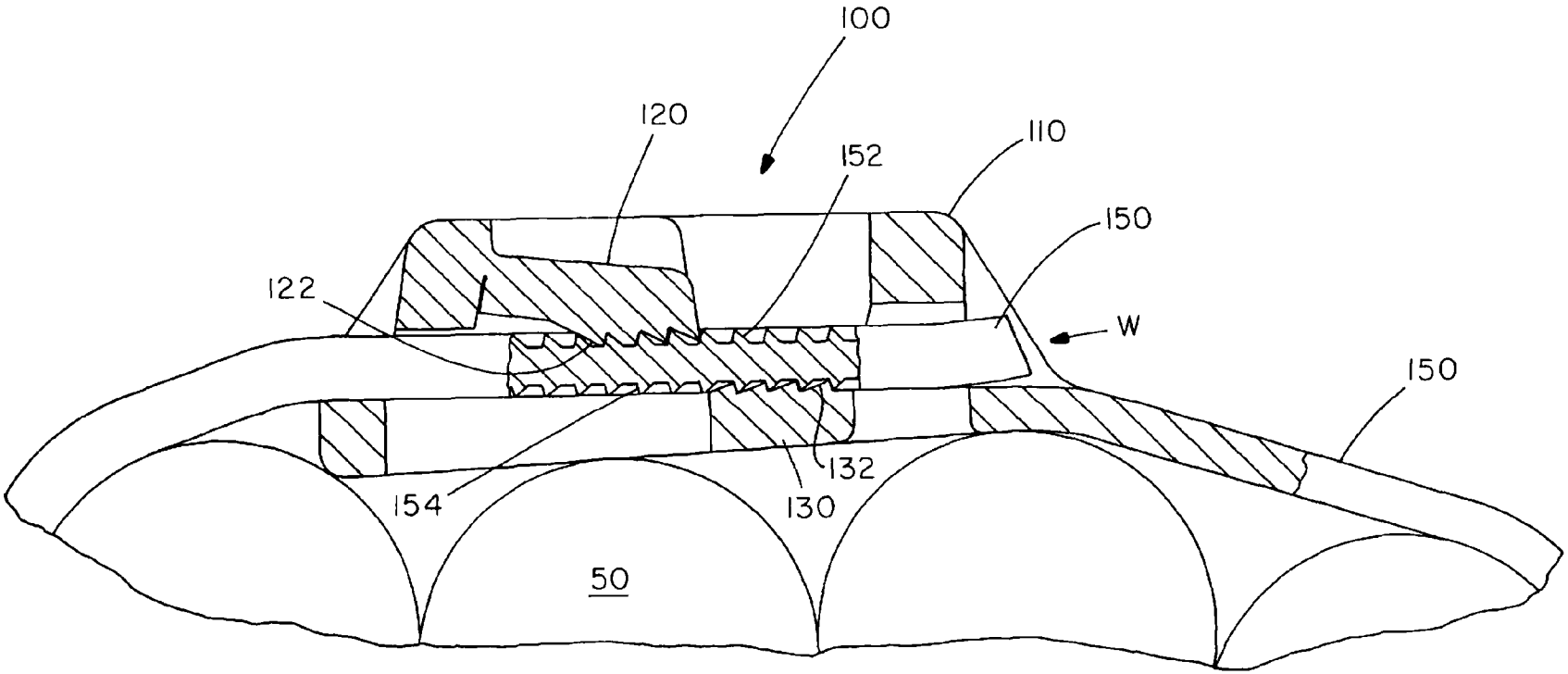
FIG. 13 shows a cross-sectional view of the cable tie of FIG. 11, upon application of withdrawal forces on the cable strap, showing flexing of the hinged locking wedge and engagement of the fixed teeth.
Figure 14:
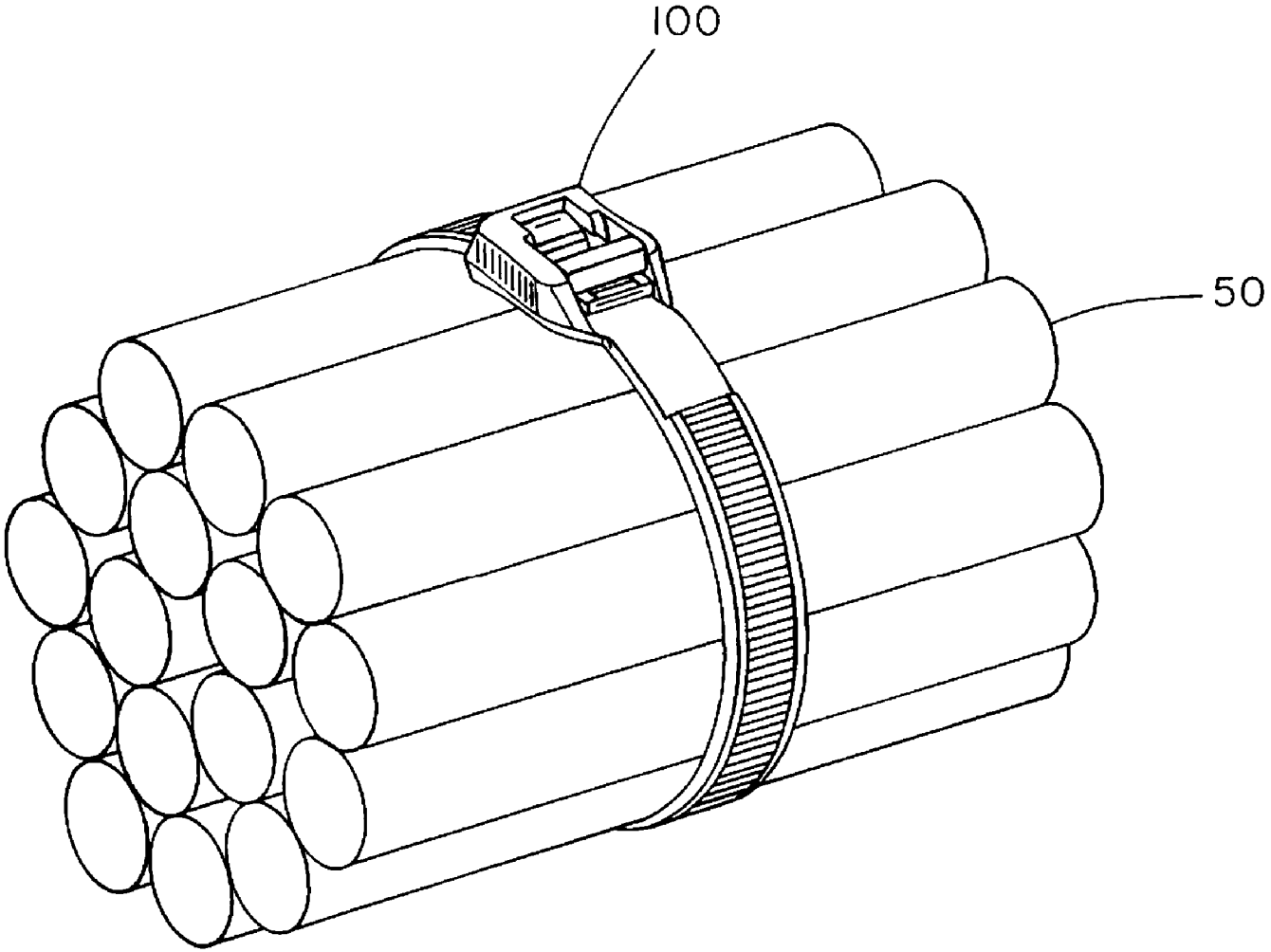
FIG. 14 shows a perspective view of the resultant bundled wires.

Once strap 150 has been tightened, a withdrawal force in direction W acts on the cable tie. This urges the hinged locking wedge 120 downward into tighter engagement with strap 150 as shown in FIG. 13. As a result, teeth 122 of hinged locking wedge 120 become better engaged with corresponding teeth 152 of strap 150. Also, this downward urging forces strap 150 downward against the bottom of the passageway and against fixed locking wedge 130 to enable fixed wedge teeth 132 to become better engaged with corresponding teeth 154 of strap 150. Thus, upon application of further withdrawal force in direction W, the effective passline clearance reduces and the grip of the various teeth of the hybrid locking wedges increases to provide a very high loop tensile strength that resists withdrawal of the strap from the cable tie. In an exemplary configuration, each of wedge 120 and 130 have four teeth 122, 132. This maximizes the effect of the downward urging force by the hinged locking wedge 120 and the loop tensile strength of the overall hybrid locking mechanism. In the particular embodiment shown when formed from Nylon 6.6, a 60% increase in loop tensile strength was attained compared to prior designs having only a flexible hinged locking wedge.

Although locking wedges 120, 130 should each include at least one tooth 122, 132, improved loop tensile strength can be achieved if multiple teeth 122, 132 are provided on each locking wedge since each tooth carries load. A preferred embodiment provides four teeth 122 on hinged locking wedge 120 and four teeth 132 on fixed locking wedge 130. This number has been found sufficient to provide strength comparable to currently available products. Additional teeth may attain higher tensile strength, but at diminishing return and at the expense of added material, cable tie head size, etc.

In a preferred embodiment, the hinged locking wedge 120 is located with its teeth 122 offset from teeth 132 of fixed locking wedge 130, most preferably completely non-overlapping. Preferably, the hinged locking wedge is located adjacent ingress 112. This has several advantages. First, this design requires less complicated tooling and molding procedures to mold the separate locking wedge components than when the components are directly opposed one another. This is particularly beneficial for high volume manufacturing. Additionally, this can assist in lowering thread insertion force as the forces from each locking wedge do not act on the same part of the elongated strap 150 at the same time and can allow some slight bending of the travel path.

An added benefit of the double-sided teeth 152, 154 on the elongated strap, besides increased loop tensile strength, is all increase in strap flexibility due to the teeth and associated reduced material and cross-sectional area.

It should be appreciated that various of the above-disclosed and other features and functions or alternatives thereof, may be desirably combined into many other cable ties and applications. Also, various presently unseen or unanticipated alternatives, modifications, variations or improvements therein which may be subsequently made by those skilled in the art are also intended to be encompassed by the following claims.

The invention claimed is:

1. A one-piece cable tie having a hybrid locking mechanism, comprising:

an elongated strap having a tail at one end thereof, the strap having two major surfaces and a thickness defined therebetween with each of the major surfaces being of a predetermined width and having a series of teeth extending over a substantial length of the strap;

a cable tie head attached to an opposite end of the elongated strap, the cable tie head having a body defining a strap ingress, a strap egress and an internal passageway therebetween of a height and width sufficient to receive the tail and elongated strap therethrough with a predefined passline clearance gap;

a hinged locking wedge hingedly mounted to the cable tie head and having at least one locking tooth received in the internal passageway adjacent a top or bottom periphery of the passageway for hinged engagement with at least one corresponding tooth on a first of the two major surfaces of the elongated strap; and a fixed locking wedge mounted to the cable tie head and having at least one locking tooth received in the internal passageway adjacent a bottom or top periphery of the passageway opposite the hinged locking wedge for engagement with at least one corresponding tooth on a second of the two major surfaces of the elongated strap, wherein the fixed locking wedge is completely non-overlapping from the hinged locking wedge along a longitudinal axis of the internal passageway.

2. The one-piece cable tie according to claim 1, wherein the hinged locking wedge is located adjacent the strap ingress.

3. The one-piece cable tie according to claim 1, wherein the hinged locking wedge is located on the top periphery of the internal passageway and the fixed locking wedge is located on the bottom periphery of the internal passageway.

4. The one-piece cable tie according to claim 1, wherein the cable tie is an in-line cable tie in which the longitudinal axis of the internal passageway is parallel to the elongated strap.

5. The one-piece cable tie according to claim 1, wherein a plurality of teeth are provided on each of the hinged locking wedge and the fixed locking wedge.

6. The one-piece cable tie according to claim 5, wherein four teeth are provided on each of the hinged locking wedge and the fixed locking wedge.

* * * * *

UNITED STATES PATENT AND TRADEMARK OFFICE

CERTIFICATE OF CORRECTION

PATENT NO. : 7,730,592 B2
APPLICATION NO. : 11/671719
DATED : June 8, 2010
INVENTOR(S) : Robert J. Krisel It is certified that error appears in the above-identified patent and that said Letters Patent is hereby corrected as shown below:

Column 4, line 58 which reads "elongated strap, besides increased loop tensile strength, is all" should read "elongated strap, besides increased loop tensile strength, is an"

Signed and Sealed this
Twenty-ninth Day of November, 2011

David J. Kappos

David J. Kappos
*Director of the United States Patent and Trademark Office*